US007001489B2

(12) United States Patent
Taipale et al.

(10) Patent No.: US 7,001,489 B2
(45) Date of Patent: Feb. 21, 2006

(54) PAPER MACHINE FABRIC

(75) Inventors: Seppo Taipale, Siilinjärvi (FI); Terttu Turpeinen, Juankoski (FI); Tania Rautio, Kuopio (FI); Pekka Kortelainen, Juankoski (FI)

(73) Assignee: Tamfelt OYJ ABP, Tampere (FI)

( * ) Notice: Subject to any disclaimer, the term of this patent is extended or adjusted under 35 U.S.C. 154(b) by 274 days.

(21) Appl. No.: 10/410,357

(22) Filed: Apr. 10, 2003

(65) Prior Publication Data

US 2004/0003860 A1 Jan. 8, 2004

(30) Foreign Application Priority Data

May 6, 2002 (FI) ..... 20020856

(51) Int. Cl.
*D21F 1/10* (2006.01)
*D03D 3/04* (2006.01)

(52) U.S. Cl. ..... 162/348; 162/902; 162/903; 139/383 A; 139/425 A; 442/206; 442/207

(58) Field of Classification Search ..... 162/109–117, 162/205–207, 348, 358.2, 900–904; 139/383 A, 139/425 A; 28/110, 142; 442/183, 189, 442/194, 203–207; 34/111, 116, 123
See application file for complete search history.

(56) References Cited

U.S. PATENT DOCUMENTS 4,501,303 A 2/1985 Osterberg
5,013,330 A * 5/1991 Durkin et al. ..... 51/297
5,597,450 A * 1/1997 Baker et al. ..... 162/348
5,826,627 A * 10/1998 Seabrook et al. ..... 139/383 A
5,944,062 A * 8/1999 Gampe ..... 139/383 A
5,967,195 A 10/1999 Ward
6,354,335 B1 * 3/2002 Taipale et al. ..... 139/383 A

FOREIGN PATENT DOCUMENTS

EP 0 426 288 A3 5/1991
EP 0 431 750 A3 6/1991
SE 7806764-2 12/1979

* cited by examiner

*Primary Examiner*—Eric Hug
(74) *Attorney, Agent, or Firm*—Oliff & Berridge, PLC

(57) ABSTRACT

A paper machine fabric comprising at least two separate layers formed using at least two separate yarn systems: one constituting the paper side and comprising machine direction and cross machine direction yarns and the other constituting the machine side and comprising machine direction and cross machine direction yarns, the yarn systems being arranged to form independent structures in both directions of the fabric. The structures are bound together with binder yarns, a binder yarn being arranged to form part of the weave of a layer on the paper side surface and arranged to be interwoven with a layer of the machine side by being interwoven under at least one yarn in the machine side layer. The number of machine direction yarns in the layer constituting the machine side is larger than the number of machine direction yarns in the layer constituting the paper side.

44 Claims, 3 Drawing Sheets

PAPER MACHINE FABRIC

BACKGROUND

The invention relates to a paper machine fabric comprising at least two separate layers formed using at least two separate yarn systems: a yarn system constituting the paper side and comprising machine direction and cross machine direction yarns and a yarn system constituting the machine side and comprising machine direction and cross machine direction yarns, the yarn systems being arranged to form independent structures in the machine and cross machine directions of the fabric and the structures being bound together by means of binder yarns, a binder yarn being arranged to form part of the weave of a layer on the paper side surface and arranged to be interwoven with a layer of the machine side by being interwoven under at least one yarn in the machine side layer.

Conventional triple layer paper machine fabrics and structures bound with a binder yarn pair are known in the field. Conventional triple layer paper machine fabrics comprise two separate layers: a paper side layer and a machine side layer. The paper side layer and the machine side layer are interconnected mainly by means of a binder weft, which serves as a binder yarn. Binding with a binder yarn usually takes place at every fourth top and bottom yarn pairs, i.e. relatively seldom. On the topside, the binding takes place over one top warp and on the bottom side, under one bottom warp. The binder yarn does not contribute to the forming of the paper side surface, but only to the binding of the layers. Swedish patent 420,852 describes the technology.

U.S. Pat. Nos. Publications 4,501,303, 5,967,195 and 5,826,627, for instance, describe techniques employed for binding structures using a binder yarn pair. In the structures bound using a binder yarn pair, instead of the binder yarn, it is the binder yarn pair responsible for binding the layers. A binder yarn pair comprises two adjacent binder yarns, one of the binder yarns establishing the paper side surface weave and the other simultaneously binding a paper side layer and a machine side layer together under one machine side bottom warp and vice versa. The path of the binder yarn pair on the paper side surface establish a weft path similar to the top weft.

Typically, in conventional triple layer paper machine fabrics and in structures bound with a binder yarn pair, the diameter of the top warp is distinctly smaller than the bottom warp. As large a difference in the diameter as top warp 0.13 mm and bottom warp 0.21 mm is generally used. In these structures, each top warp in the paper side layer is bound in the same way to the top wefts according to the weave repeat interruption on the paper side, and each bottom warp in the machine side layer is bound in the same way to the bottom wefts according to the weave repeat interruption on the machine side.

Both conventional triple layer paper machine fabrics and structures bound with a binder yarn pair usually employ as many top warps as bottom warps, i.e. warp ratio is 1:1. Since the number of top warps is equal to that of bottom warps, weft density cannot be raised sufficiently. Thick bottom warps and the relatively high density of the top warps also complicate raising weft density. When weft density remains low, the openings on the paper side surface are in the shape of a rectangle standing on the short side, i.e. the long side is parallel to the machine direction. When a paper web is formed, paper fibers are oriented in the machine direction. In other words, the paper fiber and the openings in the paper machine fabric are parallel, resulting in a poor support for the paper fiber.

In structures bound with a binder yarn pair, the yarns in the binder yarn pair cross at a point where one binder yarn descends in the fabric from the paper side in order to bind the layers, while the other binder ascends in the fabric to form the surface of the paper side. The top weft positioned at both sides of the intersection presses the top warp yarns at the intersection downwards and, simultaneously, both yarns of the binder yarn pair descend into the fabric, not supporting the top warp yarns from below. Consequently, the intersections remain on a lower plane than the surface, which may cause marking.

Abrasion of a binder yarn inside the fabric causes often 'innerside wear' in conventional triple layer paper machine fabrics. The abrasion causes the fabric to lose its original thickness on the inner side of the fabric, while the binder yarn, however, retains its original length, making the binder yarn project from the surface of the wire, subjecting the paper web to the risk of marking. Strong innerside wear may cause the binder yarns to break and the layers to become delaminated from each other.

Innerside wear may also be found in structures bound with a binder yarn pair. A binder yarn pair formed from thin binder yarns does not bind the thick bottom warps sufficiently tightly, resulting in a loose structure and causing the risk of innerside wear. The use of thick bottom warps results in a thick fabric, and the loose binding further thickens the fabric. This causes a large void volume in the paper machine fabric, resulting in water carrying of the paper machine fabric in the paper machine, and splashing may occur in some fast paper machines. Splashing occurs in a paper machine at the point where the top wire turns to the return cycle, and in the worst case the splashing causes weakening of the quality of the paper web. Since a thick paper machine fabric impairs the effect of vacuum and dewatering elements compared with a thin paper machine fabric, the dry matter content in the paper is reduced. Another reason for a low dry matter content is a large void volume, which increases 'rewetting'. In rewetting, the water removed from the paper web to the wire is absorbed back to the paper web in the wire section after the last dewatering elements before the press section. Because the paper web is wetter when entering the press section, breaks increase and, on the other hand, the steam consumption in the paper machine increases. Both factors significantly raise the costs at a paper machine.

A thick bottom warp also causes a high bending of the paper machine fabric in the machine direction, which is a problem in papermaking and dewatering. In the machine direction, a stiff paper machine fabric does not follow to the dewatering equipment, resulting in less turbulence and impaired dewatering and paper web formation. Herein, turbulence refers to whirling and mixing of the dewatering equipment caused by the paper web.

SUMMARY

A thick paper machine fabric may cause problems for a paper web in edge trimming. The effect of the edge trim squirt is insufficient to push the fibers through the thick structure, resulting in the risk of wire blocking and impaired trimming. Edge trimming problems significantly increase wet end breaks. Furthermore, the thicker the paper machine fabric is, the more difficult it is to keep it clean, resulting in an increased need for extra washing downtime.

An object of the invention is to provide a paper machine fabric enabling the elimination of prior art drawbacks. This is achieved by means of the paper machine fabric according to the invention. The paper machine fabric of the invention is wherein the number of machine direction yarns in the layer constituting the machine side is larger than the number of machine direction yarns in the layer constituting the paper side.

The structure of the invention enables the use of thin warp and weft yarns in both the paper and machine side layers, whereby a thin structure is achieved. Since the paper machine fabric is thin, the structure also has a smaller void volume than conventional triple layer paper machine fabrics and structures bound with a binder yarn pair. A small void volume results in less previously mentioned rewetting in the structure. Thin warp yarns reduce the bending stiffness of the paper machine fabric in the machine direction. A low bending stiffness allows the paper machine fabric to follow to the dewatering equipment of the paper machine, resulting in good dewatering and paper web formation. A thin structure is also advantageous in paper web edge trimming. It is easier for the edge trim squirt to push the fibers through a thin fabric.

In conventional triple layer paper machine fabrics, a problem may be caused by the movement of the bottom wefts in the machine direction. This causes marking in the paper. In the structure of the invention, the machine side comprises more binding points than conventional triple layer paper machine fabrics. The bottom wefts are prevented from moving by binding the bottom wefts sufficiently tightly. A large number of binding points improves the diagonal stability of the paper machine fabric, which correlates with a stable paper machine fabric. A stable paper machine fabric has good runnability on the paper machine and it contributes to the achievement of even paper profiles. A tight binding prevents the movement of the paper and machine side layers relative to each other, whereby no innerside wear is formed in the fabric.

Since in the structure of the invention the top warp density is lower than in conventional triple layer paper machine fabrics, the top weft density can be increased in order for the long side of the rectangular openings in the paper machine fabric on the paper side surface to be in the cross direction of the paper machine, i.e. perpendicular to the direction in which the paper fibers are mainly oriented when a paper web is made, whereby an optimal fiber support and dewatering are achieved.

Since the total warp density is high in the structure of the invention, the elongation of the paper machine fabric in the machine direction remains lower than in conventional triple layer paper machine fabrics and in structures bound with a binder yarn pair. Furthermore, in a structure of the invention, every other bottom warp runs in the fabric straighter than every other bottom warp, and thus the elongation of the fabric in the machine direction is reduced.

In the structure of the invention, the cover factor of the top warps is clearly lower than the cover factor of the bottom warps, which results in funnel-shaped capillaries, advantageous to dewatering, being formed in the structure. As for rewetting, such a structure is advantageous since capillary forces move water from the paper machine fabric towards the machine side surface of the structure. The cover factor of a warp is defined as follows:

Cover factor of a warp=d×n, wherein d=warp diameter (cm) and n=number of warps/cm.

In structures bound with a binder yarn pair, the support to the top warp at the intersection of the binder yarns becomes poor from below, which results in the top warp remaining lower than its surrounds at this point, whereby said point causes marking in the paper. In embodiments of the invention, a well supporting bridge structure is formed from the substitute weft at the point where the binder yarn lowers to bind the machine side, the bridge lifting said point flush with its surrounds, whereby no marking occurs. Since the fabric of the invention does not comprise binder yarn pairs tightening the structure, the bottom side weft density can be increased without the fabric becoming too tight, the machine side thus comprising more material and the fabric more resistance to wear.

The paper machine fabric of the invention comprises at least two machine direction yarn systems, e.g. a top warp system and a bottom warp system, and at least two cross machine direction yarn systems, e.g. a top weft system and a bottom weft system. The top weft system comprises at least a substitute weft. The fabric structure also always comprises a binder yarn system. In the invention, the yarn system constituting the paper side comprises a substitute weft, a binder yarn being woven on both sides thereof. The substitute weft is arranged to complete the two yarn paths formed by the above-mentioned two binder yarns on the paper side at points where said two binder yarns are interwoven with the machine side.

BRIEF DESCRIPTION OF THE DRAWINGS

In the following, the invention will be described in detail by means of embodiments described in the attached drawing, wherein.

DETAILED DESCRIPTION OF EMBODIMENTS

Figure 1:
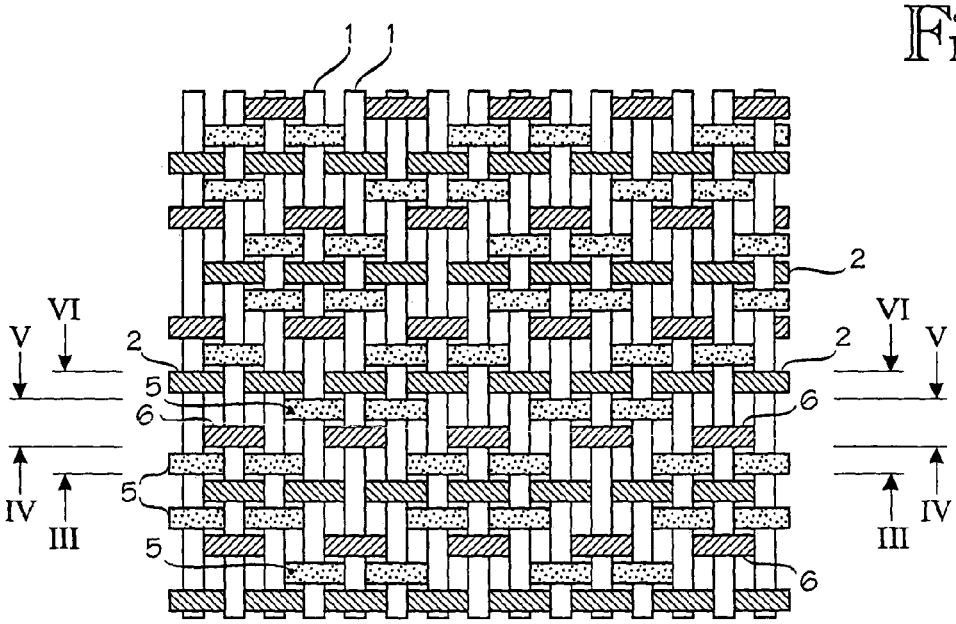
FIG. 1 shows a paper machine fabric of the invention seen from the paper side.

FIGS. 1 to 6 shows an embodiment of a paper machine fabric of the invention, comprising a top warp system and a bottom warp system composed of two bottom warps. The top warp system and a top weft system constitute the paper side layer, and the bottom warp system and a bottom weft system the machine side layer, respectively. There may also be several machine direction yarn systems, e.g. three machine direction yarn systems, a top warp system and two bottom warp systems, as was stated above.

In FIGS. 1 to 6, the top warps are denoted by reference number 1 and the top wefts by reference number 2, respectively. In FIG. 1 to 6, the bottom warps are denoted by reference numbers 3*a* and 3*b*, and the bottom wefts by reference number 4. The layer constituting the paper side and the layer constituting the machine side are interwoven by means of a binder yarn system. Binder yarns are denoted by reference number 5. A binder yarn 5 constitutes part of the weave of the layer on the paper side surface, and enters and exits the machine side to bind the layers together by becoming interwoven under at least one bottom warp 3*a* or 3*b*.

Two bottom warp systems may comprise more bottom warps 3*a* and 3*b*, e.g. twice as many as there are top warps 1 in the top warp system. The bottom warps 3*a*, 3*b* are substantially thinner in diameter than the bottom warps in a conventional triple layer paper machine fabrics. In the structure of FIGS. 1 to 6, the bottom warps 3*a*, 3*b* are slightly thinner in diameter than the top warps 1. The bottom warps 3*a*, 3*b* may also be of different thickness. It is essential that the top and bottom warps are mutually equal in thickness or almost equal in thickness, either the top warp being thicker or the bottom warp being thicker.

Figure 2:
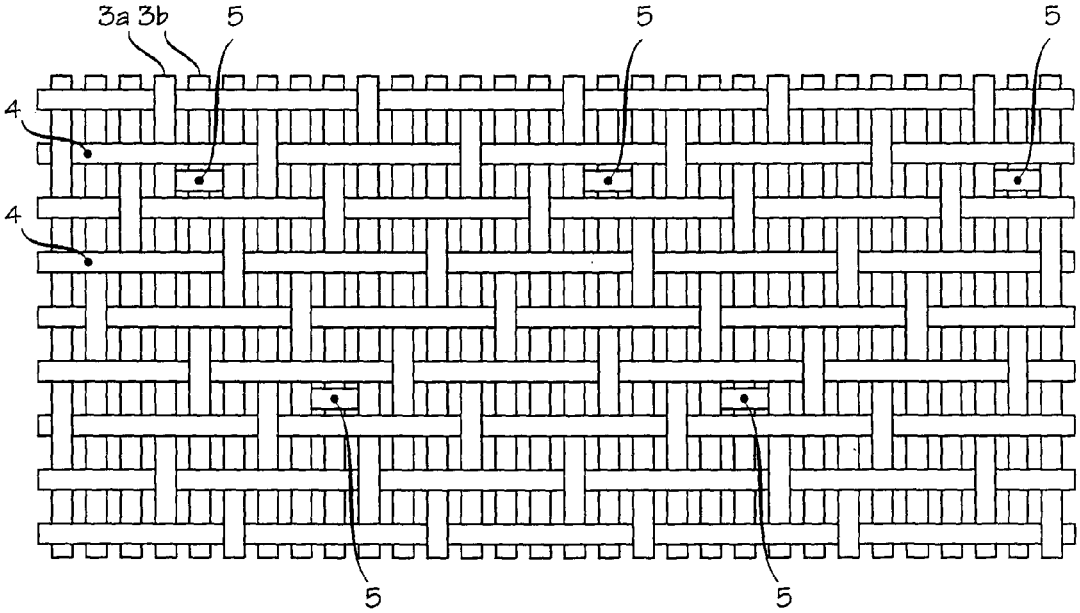
FIG. 2 shows a paper machine fabric of the invention seen from the machine side.

FIG. 2 shows machine side surface showing the binding of the bottom warps 3*a* and 3*b*. In this embodiment, each bottom warp 3*a* and 3*b* is bound in the same way to the bottom warps 4 according to the weave repeat interruption on the machine side.

The structure of the invention is made thin by using alignment of top and bottom warp yarns. In the structure, the top warps 1 are not quite on top of each other, but partly overlap the bottom warps 3*a*, 3*b*, allowing the warps to interlock. For the same reason, the machine side binding point rises as close to the paper side surface as possible at the point where the paper side layer and the machine side layer are interwoven with a binder yarn 5, making the structure thin. A thin bottom warp contributes to the rise of the binding point.

In the embodiment of the invention according to FIGS. 1 to 6, a substitute weft 6 completes the weft paths formed by the binder yarn woven on both sides of the substitute weft on the paper side at the points where the binder yarn 5 is interwoven with the machine side. The binder yarns 5 and the substitute weft 6 woven between them thus form two weft paths on the paper side surface that are similar to the weft path on the actual top weft 2. Consequently, the two binder yarns 5 and the substitute weft 6 woven between them form two weft paths on the paper side surface.

Figure 3:
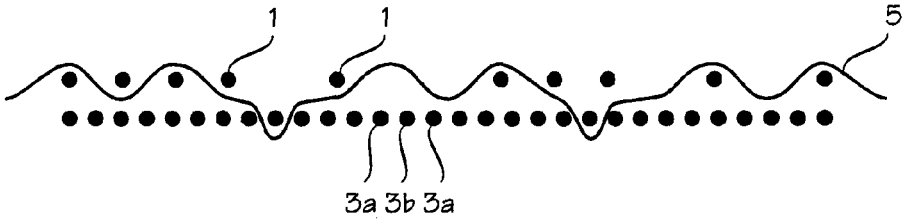
FIG. 3 shows the embodiment of FIG. 1 taken along arrows III—III.
Figure 4:
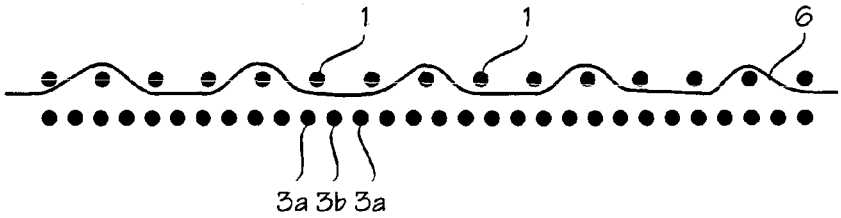
FIG. 4 shows the embodiment of FIG. 1 taken along arrows IV—IV.
Figure 5:
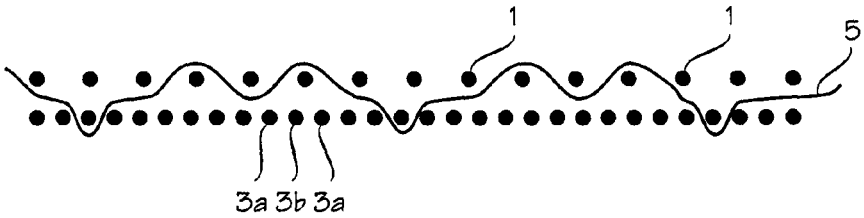
FIG. 5 shows the embodiment of FIG. 1 taken along arrows V—V.
Figure 6:
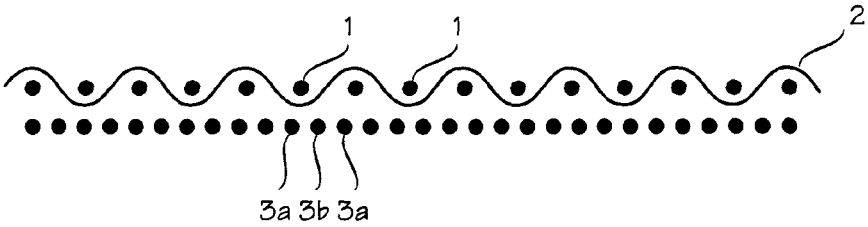
FIG. 6 shows the embodiment of FIG. 1 taken along arrows VI—VI.

On the paper side surface of the embodiment of the invention shown in FIGS. 1 to 6, the top weft 2, binder yarn 5, substitute weft 6 and binder yarn 5 constitute a group of yarns that regularly and repeatedly runs through the fabric. The top weft 2 is bound using a plain weave. The binder yarn 5 is bound on the paper side surface and descends to bind the layers together by being interwoven under one bottom warp 3*a* or 3*b*, i.e. as is shown in FIGS. 3 and 5, for example. The bottom wefts 4 are bound to the bottom warps 3*a* using a 3-shed weave and to the bottom warps 3*b* using a 3-shed weave. Thus, the binder yarn 5 interweaves under one bottom warp, i.e., 3*a* or 3*b*, using a 6-shed weave. For example, when looking at FIG. 3 and counting either warp yarns 3*a* or 3*b*, the binder yarn 5 interweaves under one bottom warp using a 6-shed weave.

In structures bound with a binder yarn pair, an individual binder yarn is bound as a 10-shed weave on the paper side surface, five top warp yarns remaining between the portions constituting the paper side surface. Consequently, the binding of the paper side and machine side layers remains loose, and the outermost binding points of the portions of the binder yarn constituting the paper side surface remain higher than the middle part, making the surface uneven and increasing the risk of marking. In the structure of FIGS. 1 to 6, only three top warp yarns remain between the portions of the binder yarn constituting the paper side surface, the binding being tight, whereby the paper side surface becomes even and the risk of marking in the structure is reduced.

| PROPERTY | A structure of the invention | Conventional triple layer wire | Structure bound with binder yarn pair |
|---|---|---|---|
| MD YARNS: ø/density | | | |
| Top warp (mm/yarn/cm) | 0.14/28.2 | 0.14/30.5 | 0.14/31 |
| Bottom warp (mm/yarn/cm) | 0.13/56.4 | 0.21/30.5 | 0.21/31 |
| CMD YARNS: ø/density | | | |
| Top weft (mm/yarn/cm) | 0.13/12.2 | 0.16/26.7 | 0.13/19.3 |
| Substitute weft (mm/yarn/cm) | 0.14/12.2 | — | — |
| Binder weft (mm/yarn/cm) | 0.13/12.2 | 0.13/6.7 | 0.13/19.3 |
| Bottom weft (mm/yarn/cm) | 0.18/24.4 | 0.22/26.6 | 0.25/19.4 |
| MD yarn density (yarn/cm) | 84.6 | 61 | 62 |
| CMD yarn density (yarn/cm) | 61 | 54 | 58 |
| T-count | 146 | 121 | 120 |
| S-count | 65 | 58 | 70 |
| Permeability ($m^3/m^2/h$) | 5500 | 5500 | 5500 |
| Wear margin (mm) | 0.17 | 0.20 | 0.22 |
| MD bending stiffness (mN) | 184 | 300 | 380 |
| Thickness (mm) | 0.63 | 0.73 | 0.80 |
| Warp cover factor paper side/machine side | 0.395/0.733 | 0.427/0.641 | 0.434/0.651 |

The enclosed table compares the preferred structure of FIGS. 1 to 6 with a conventional triple layer wire structure and with a structure bound with a binder yarn pair. The paper machine fabrics of the table are suited to be run in a paper machine as alternative fabrics.

The table shows that the structure of the invention is distinctly thinner than the other structures. Consequently, the void volume in the structure is also small and the structure does not carry water along with it. In other words, less rewetting occurs in the structure, and on the paper machine, the top wire in the return cycle does not splash water onto the paper web. MD bending stiffness indicates the stiffness of the paper machine fabric in the machine direction. In conventional triple layer wire structures and in structures bound with a binder yarn pair, the bending stiffness is higher than in the structure of the invention. The advantages brought forth by the low bending stiffness of the structure of the invention include high dry matter content and good formation of the paper.

Figure 8:
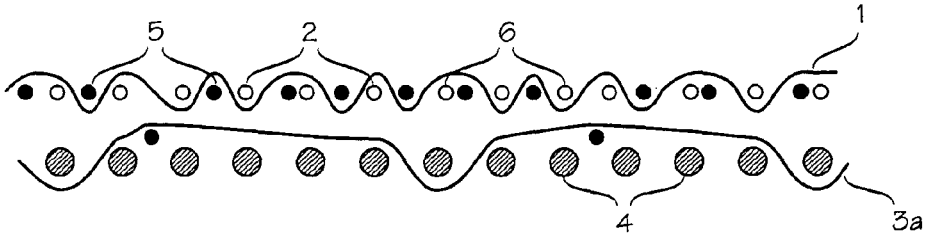
FIG. 8 shows the embodiment of FIG. 7 taken along arrows VII—VII.
Figure 9:
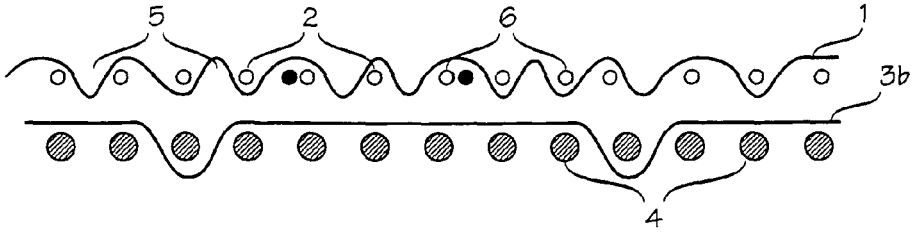
FIG. 9 shows the embodiment of FIG. 7 taken along arrows VIII—VIII.
Figure 7:
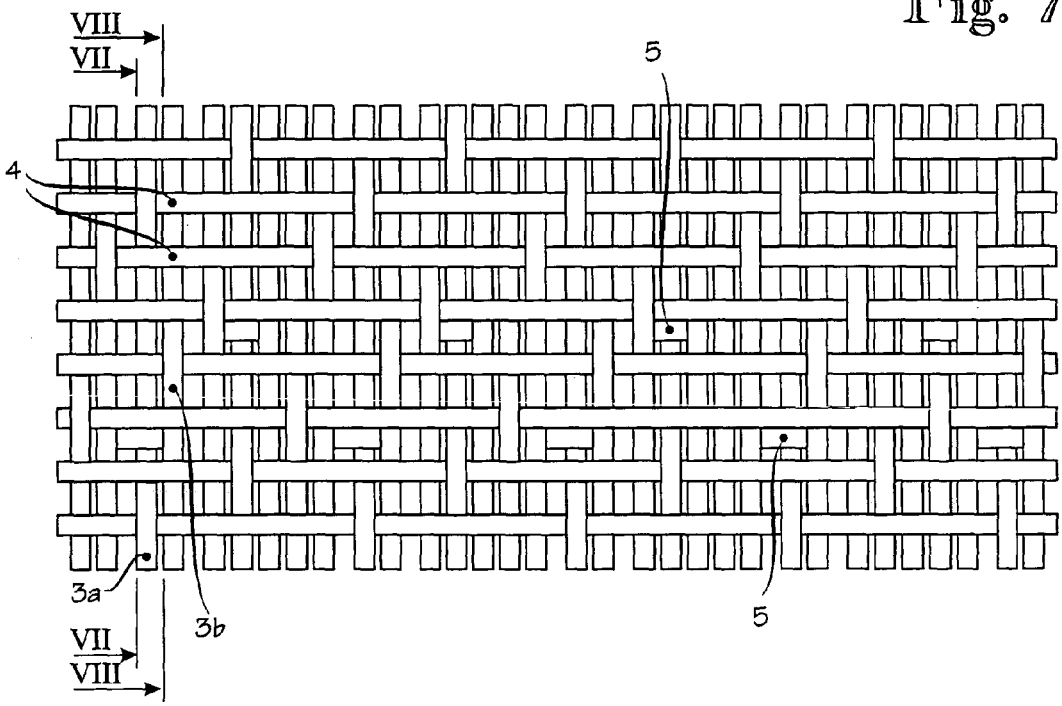
FIG. 7 shows a second paper machine fabric of the invention seen from the machine side.

FIG. 7 to 9 show a second embodiment of the paper machine fabric of the invention. In this embodiment, the bottom warps 3*a* and 3*b* are bound in a different manner. FIGS. 7 and 8 show how the binder yarn 5 enters and exits the machine side to bind the layers constituting the paper side and machine side together by becoming interwoven under one bottom warp 3*a*. The advantage of the structure is that the bottom warp system formed by the bottom warp 3*b* runs in the structure straighter than the bottom warps 3*a*, whereby the machine direction stretch of the paper machine fabric remains extremely low.

Figure 10:
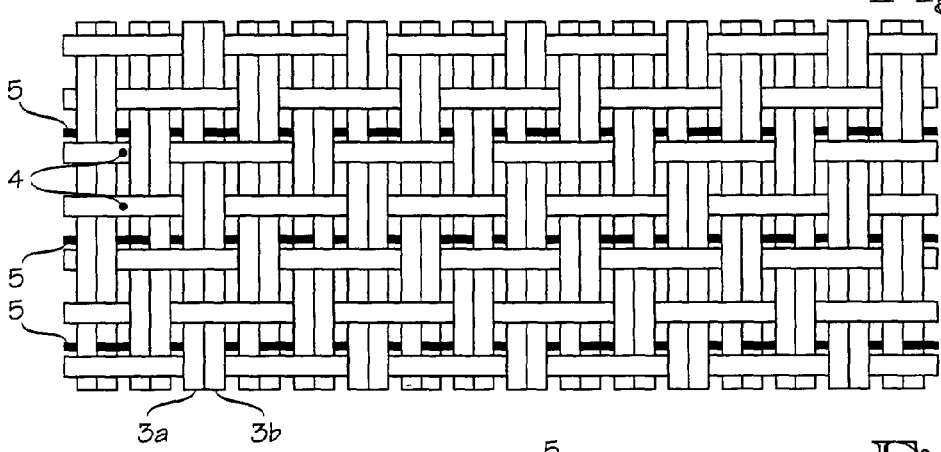
FIG. 10 shows a third paper machine fabric of the invention seen from the machine side.

FIG. 10 shows a third embodiment of the paper machine fabric of the invention. In FIG. 10, the bottom warps 3*a* and 3*b* run in the weave in parallel, being interwoven with the bottom wefts 4 always in the same way. In this embodiment, the binder yarn 5 enters and exits the machine side, binding the layers constituting the paper side and the machine side together by becoming interwoven under either bottom warp 3*a* or 3*b*.

Figure 11:
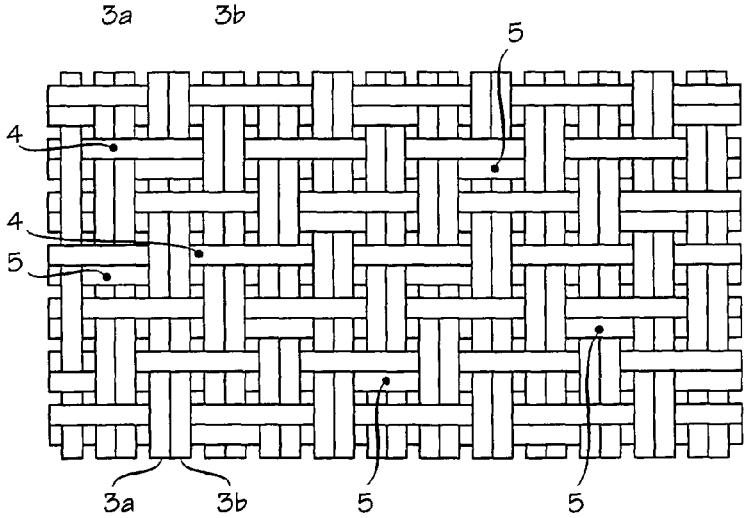
FIG. 11 shows a fourth paper machine fabric of the invention seen from the machine side.

FIG. 11 shows a fourth embodiment of the paper machine fabric of the invention. In FIG. 11, the bottom warps 3*a* and 3*b* run in the weave in parallel, being interwoven with the bottom wefts 4 always in the same way. In this embodiment, the binder yarn 5 enters and exits the machine side, binding the layers constituting the paper side and the machine side together by becoming interwoven under each bottom warp 3*a* and 3*b*.

In the embodiments of FIGS. 7 to 9, 10 and 11, the paper side is similar to what was presented above in the example of FIGS. 1 to 6, i.e. only the machine sides in the examples of FIGS. 7 to 9, 10 and 11 are different from those of the example of FIGS. 1 to 6.

The embodiments disclosed above are by no means intended to restrict the invention, but the invention can be modified freely within the scope of the claims. It is thus obvious that the paper machine fabric of the invention or the details thereof do not necessarily have to be identical to those shown in the figures but other solutions are also feasible. The separate layers can be formed very freely, i.e. such that the number of yarn systems may vary, the essential point being that there are at least two warp systems: a bottom warp system and a top warp system. Similarly, the number of weft systems may also vary, the essential point being that there are at least two weft systems: a top weft system and a bottom weft system etc. The structure of the invention described above is a triple layer one, but other multilayer structures are feasible within the scope of the invention. On the paper side surface, instead of the plain weave, also other weaves, such as satin or twill weaves, can be used. The weaves of the bottom wefts and the binder yarns may also vary freely within the basic idea of the invention. It is further to be noted that the basic idea of the invention enables structures that completely lack top wefts, i.e. a structure wherein the paper side is provided with substitute wefts and binder yarns only. On the other hand, it is also perfectly feasible to form structures wherein the number of top wefts is larger than the number of substitute wefts, i.e. the number of top wefts may vary, being e.g. 0, 1, 2, 3, etc. The number of bottom wefts may differ from the total number of top wefts and substitute wefts. In the examples, the number of bottom wefts is equal to the total number of top wefts and substitute wefts, but the number of bottom wefts may also be unequal.

The travel paths of the binder yarns 5 adjacent the substitute weft 6 in the fabric may be similar or different. The number of binding points in the substitute weft 6 on the paper side surface may be equal to or different from the number of binding points of the adjacent binder yarn 5 on the paper side surface. If there is only one top weft, then the top weft is the substitute weft 6. In the examples of the figures, the binder yarns 5 and the substitute weft 6 woven between them constitute a group of two weft paths on the paper side surface. The paper side surface may be composed only of these groups or one or more top wefts may be woven between the groups. The binding of the top weft may be similar to or different from that on the weft paths formed jointly by the binder yarns and the substitute yarn.

All solutions set forth above employ polyester or polyamide yarns with circular cross-sections. Other possible yarn materials include e.g. PEN (polyethylene naphthalate) and PPS (polyphenylene sulfide). However, the invention is in no way restricted to the above examples, but the invention can be applied in association with different yarns. The yarns or some yarns may also be for instance 'profile yarns', whose cross-section is not round, but instead e.g. flat, oval or some other shape. The yarns or some yarns may also be hollow, for instance, allowing the yarns to flatten in the fabric, making the structure still thinner. Similarly, what are known as bicomponent yarns can also be used as yarns. The choice of yarn properties affects the properties of the fabric; an increasingly thinner structure or an even paper side surface etc. is achieved.

The invention claimed is:

1. A paper machine fabric, comprising:

at least two separate layers formed using at least two separate yarn systems:

a yarn system constituting the paper side and comprising warps and wefts; and a yarn system constituting the machine side and comprising warps and wefts, the yarn systems being arranged to form independent structures in the warps and wefts of the fabric and the structures being bound together by means of binder yarns;

a binder yarn being arranged to form part of a weave of a layer on the paper side surface and arranged to be interwoven with a layer of the machine side by being interwoven under at least one yarn in the machine side layer, in which paper machine fabric the number of warps in the layer constituting the machine side is larger than the number of warps in the layer constituting the paper side; and a pair of parallel bottom warps run in the weave by becoming interwoven with bottom wefts always in the same manner either at the same or a different stage, and the binder yarn enters and exits the machine side to bind the layers constituting the paper side and the machine side together by becoming interwoven under either bottom warp.

2. The paper machine fabric as claimed in claim 1, wherein the number of warps in the layer constituting the machine side is twice the number of warps in the layer constituting the paper side.

3. The paper machine fabric as claimed in claim 1, wherein the diameter of the warps in the layer constituting the machine side is smaller or larger than, but not substantially different from the diameter of the warps in the layer constituting the paper side.

4. The paper machine fabric as claimed in claim 1, wherein the diameter of the warps in the layer constituting the machine side is equal to the diameter of the warps in the layer constituting the paper side.

5. The paper machine fabric as claimed in claim 1, wherein the number of warp systems in the layer constituting the machine side is at least two and that the yarns of each yarn system are of different thickness.

6. The paper machine fabric as claimed in claim 1, wherein bottom warps in the layer constituting the machine side partly overlap top warps in the layer constituting the paper side.

7. The paper machine fabric as claimed in claim 1, wherein the yarn system constituting the paper side comprises a substitute weft, two binder yarns, each one of the two binder yarns being woven on one side of the substitute weft, and the substitute weft is arranged to complete the two yarn paths formed by the two binder yarns on the paper side at points where the two binder yarns are interwoven with the machine side.

8. The paper machine fabric as claimed in claim 7, wherein at least one top weft is woven between a yarn group of the two yarn paths formed by the substitute weft and the binder yarns.

9. The paper machine fabric as claimed in claim 7, wherein one top weft is woven between a yarn group of the two yarn paths formed by the substitute weft and the binder yarns.

10. The paper machine fabric as claimed in claim 7, wherein the travel paths of the binder yarns adjacent to the substitute weft are equal in the fabric.

11. The paper machine fabric as claimed in claim 7, wherein the travel paths of the binder yarns adjacent to the substitute weft are different in the fabric.

12. The paper machine fabric as claimed in claim 7, wherein the binder yarn has two binding points on the paper side surface.

13. The paper machine fabric as claimed in claim 7, wherein the binding of the top weft is similar to that of the weft paths formed jointly by the binder yarns and the substitute weft on the paper side surface.

14. The paper machine fabric as claimed in claim 7, wherein the binding of the top weft is different from that of the weft paths formed jointly by the binder yarns and the substitute weft on the paper side surface.

15. The paper machine fabric as claimed in claim 7, wherein the number of binding points in the substitute weft on the paper side surface is equal to or different from the amount of binding points in the adjacent binder yarn on the paper side surface.

16. The paper machine fabric as claimed in claim 7, wherein the number of substitute wefts is equal to that of top wefts, and the number of bottom wefts is equal to the total number of top wefts and substitute wefts.

17. The paper machine fabric as claimed in claim 7, wherein the weft path formed by the substitute weft and the binder yarns is formed such that there are two binder yarn binding points and one substitute weft binding point.

18. The paper machine fabric as claimed in claim 17, wherein plain weave yarn paths are formed on the paper side surface.

19. The paper machine fabric as claimed in claim 18, wherein the binder yarn binds the paper and machine side layers together by interweaving under one bottom warp system composed of two groups of warp yarns each using a 6-shed weave, the bottom wefts interweave with one group of warp yarns of the bottom warp system using a 3-shed weave and with the other group of warp yarns of the bottom warp system using a 3-shed weave.

20. The paper machine fabric as claimed in claim 1, wherein the binder yarn binds the paper and machine side layers together by interweaving under one bottom warp system composed of two groups of warp yarns each using a 6-shed weave, the bottom wefts interweave with one group of warp yarns of the bottom warp system using a 3-shed weave and with the other group of warp yarns of the bottom warp system using a 3-shed weave.

21. The paper machine fabric as claimed in claim 1, wherein the cross-section of one, some or all yarns of the paper machine fabric differs from round.

22. The paper machine fabric as claimed in claim 1, wherein one, some or all yarns of the paper machine fabric are hollow.

23. A paper machine fabric, comprising:

at least two separate layers formed using at least two separate yarn systems:

a yarn system constituting the paper side and comprising warps and wefts; and a yarn system constituting the machine side and comprising warps and wefts, the yarn systems being arranged to form independent structures in the warps and wefts of the fabric and the structures being bound together by means of binder yarns;

a binder yarn being arranged to form part of a weave of a layer on the paper side surface and arranged to be interwoven with a layer of the machine side by being interwoven under at least one yarn in the machine side layer, in which paper machine fabric the number of warps in the layer constituting the machine side is larger than the number of warps in the layer constituting the paper side; and a pair of parallel bottom warps run in the weave by becoming interwoven with bottom wefts always in the same manner either at the same or a different stage, and the binder yarn enters and exits the machine side to bind the layers constituting the paper side and the machine side together by becoming interwoven under both bottom warps.

24. The paper machine fabric as claimed in claim 23, wherein the number of the warps in the layer constituting the machine side is twice the number of warps in the layer constituting the paper side.

25. The paper machine fabric as claimed in claim 23, wherein the diameter of the warps in the layer constituting the machine side is smaller or larger than, but not substantially different from the diameter of the warps in the layer constituting the paper side.

26. The paper machine fabric as claimed in claim 23, wherein the diameter of the warps in the layer constituting the machine side is equal to the diameter of the warps in the layer constituting the paper side.

27. The paper machine fabric as claimed in claim 23, wherein the number of warps systems in the layer constituting the machine side is at least two and that the yarns of each yarn system are of different thickness.

28. The paper machine fabric as claimed in claim 23, wherein bottom warps in the layer constituting the machine side partly overlap top warps in the layer constituting the paper side.

29. The paper machine fabric as claimed in claim 23, wherein the yarn system constituting the paper side comprises a substitute weft, two binder yarns, each one of the two binder yarns being woven on each side of the substitute weft, and the substitute weft is arranged to complete two yarn paths formed by the two binder yarns on the paper side at points where the two binder yarns are interwoven with the machine side.

30. The paper machine fabric as claimed in claim 29, wherein at least one top weft is woven between a yarn group of the two yarn paths formed by the substitute weft and the binder yarns.

31. The paper machine fabric as claimed in claim 29, wherein one top weft is woven between a yarn group of the two yarn paths formed by the substitute weft and the binder yarns.

32. The paper machine fabric as claimed in claim 29, wherein the travel paths of the binder yarns adjacent to the substitute weft are equal in the fabric.

33. The paper machine fabric as claimed in claim 29, wherein the travel paths of the binder yarns adjacent to the substitute weft are different in the fabric.

34. The paper machine fabric as claimed in claim 29, wherein the binder yarn has two binding points on the paper side surface.

35. The paper machine fabric as claimed in claim 29, wherein the binding of the top weft is similar to that of the weft paths formed jointly by the binder yarns and the substitute weft on the paper side surface.

36. The paper machine fabric as claimed in claim 29, wherein the binding of the top weft is different from that of the weft paths formed jointly by the binder yarns and the substitute weft on the paper side surface.

37. The paper machine fabric as claimed in claim 29, wherein the number of binding points in the substitute weft on the paper side surface is equal to or different from the amount of binding points in the adjacent binder yarn on the paper side surface.

38. The paper machine fabric as claimed in claim 29, wherein the number of substitute wefts is equal to that of top wefts, and the number of bottom wefts is equal to the total number of top wefts and substitute wefts.

39. The paper machine fabric as claimed in claim 29, wherein the weft path formed by the substitute weft and the binder yarns is formed such that there are two binder yarn binding points and one substitute weft binding point.

40. The paper machine fabric as claimed in claim 39, wherein plain weave yarn paths are formed on the paper side surface.

41. The paper machine fabric as claimed in claim 40, wherein the binder yarn binds the paper and machine side layers together by interweaving under one bottom warp system composed of two groups of warp yarns each using a 6-shed weave, and that the bottom wefts interweave with one group of warp yarns of the bottom warp system using a 3-shed weave and with the other group of warp yarns of the bottom warp system using a 3-shed weave.

42. The paper machine fabric as claimed in claim 23, wherein the binder yarn binds the paper and machine side layers together by interweaving under one bottom warp system composed of two groups of warp yarns each using a 6-shed weave, the bottom wefts interweave with one group of warp yarns of the bottom warp system using a 3-shed weave and with the other group of warp yarns of the bottom warp system using a 3-shed weave.

43. The paper machine fabric as claimed in claim 23, wherein the cross-section of one, some or all yarns of the paper machine fabric differs from round.

44. The paper machine fabric as claimed in claim 23, wherein one, some or all yarns of the paper machine fabric are hollow.

* * * * *